United States Patent [19]

Corgnet

[11] 4,010,798

[45] Mar. 8, 1977

[54] METHOD AND APPARATUS FOR COMPLETING UNDERWATER WELL HEADS

[75] Inventor: Jean Louis Corgnet, Boulogne, France

[73] Assignee: Compagnie Francaise des Petroles, Paris, France

[22] Filed: Dec. 10, 1975

[21] Appl. No.: 639,491

[30] Foreign Application Priority Data

Dec. 17, 1974 France ..... 74.41534

[52] U.S. Cl. ..... 166/.5; 175/9

[51] Int. Cl.[2] ..... E21B 43/01; E21B 7/12

[58] Field of Search ..... 166/.5, .6; 175/9

[56] References Cited

UNITED STATES PATENTS

| | | | |
|---|---|---|---|
| 2,854,215 | 9/1958 | Cox, Jr. et al. | 166/.5 |
| 3,391,734 | 7/1968 | Townsend, Jr. | 166/.5 |
| 3,408,822 | 11/1968 | Chate et al. | 166/.5 |
| 3,643,736 | 2/1972 | Talley, Jr. | 166/.5 |
| 3,661,204 | 5/1972 | Blanding et al. | 166/.5 |

*Primary Examiner*—James A. Leppink
*Attorney, Agent, or Firm*—Sughrue, Rothwell, Mion, Zinn & Macpeak

[57] ABSTRACT

In a method of completing one or a plurality of grouped underwater oil wells, each well head to be connected is temporarily placed in a gaseous medium at atmospheric pressure during connection to effect this, prior to the installation of the well head, a structure is lowered vertically on to the sea bed where the gathering is to be carried out, the structure including an enclosure at atmospheric pressure and housing a manifold, and as many compartments, capable of communicating with the enclosure, receiving a production head and being rendered watertight, as there are well heads to be installed, each compartment being temporarily rendered watertight and filled with gas at atmospheric pressure during connection of the production head, previously placed in the compartment, to the manifold in the enclosure.

21 Claims, 10 Drawing Figures

METHOD AND APPARATUS FOR COMPLETING UNDERWATER WELL HEADS

The invention refers to a method of completion of one or a plurality of grouped undersea oil wells, and a structure for use in carrying out the method.

Amongst the main known methods of completion there are those which require crews of divers. Such methods have the disadvantage of being useable only at relatively small depths. In order to avoid this disadvantage other methods use mechanisms enabling vertical or lateral connections to be carried out automatically.

The mechanisms employed are, however, complex, costly and cumbersome. Moreover complete supervision of the well head cannot be carried out. In certain cases this is corrected by carrying out lateral connections of the well head by means of an undersea enclosure provided with an airlock for access to a personnel transfer apparatus. After having exhausted the water inside the enclosure and replaced it by air at atmospheric pressure, the connection is carried out and the transfer apparatus is withdrawn. One method offering greater safety uses an enclosure at atmospheric pressure enabling the well to be controlled as it lies in the water. In this method, however, the connection had still to be effected from the outside of the enclosure so that the interest afforded by this method is counterbalanced by the usual difficulties encountered in carrying out such connections.

It is an object of the present invention to provide a method of completion of at least one undersea oil well, according to which the production head is temporarily withdrawn from the ambient medium which is replaced by a gaseous medium at atmospheric pressure, wherein prior to the installation of the well head, a structure is lowered vertically on to the sea bed where the gathering is to be carried out, the structure including an enclosure at atmospheric pressure and housing a manifold, and as many compartments, capable of communicating with the enclosure, receiving a production head and being rendered watertight, as there are well heads to be installed, installing a well head in a compartment, lowering a production head into the compartment and on to the well head, rendering the compartment watertight, removing water from the compartment from the inside of the enclosure, substituting for the water a mixture of gases at the pressure of the enclosure, connecting the production head to the manifold through a connector plate which separates the compartment from the enclosure in a watertight manner after connection, and refilling the compartment with water.

This method has the advantage that, by use of it, connection of the production head to the manifold can be carried out from the inside of the enclosure. It consequently enables the working party to remain in a zone of safety. Each compartment may be of relatively small dimensions in order to be separated from the enclosure only by a wall provided with an opening which can be shut off, rendering easily accessible the elements for connection of the production head to the manifold.

It is another object of the invention to provide a structure for carrying out the above method, the structure comprising an enclosure at atmospheric pressure and at least as many compartments as there are production heads to be installed, each compartment being connected to the enclosure by a removable watertight separator plate, being capable of receiving a production head and being rendered watertight.

The structure may be constructed of a mass of concrete which is sufficiently heavy to remain on the sea bed and increases the rigidity of the assembly of casings, tubings and preventers during the operations of drilling and completion. Advantageously the structure includes in an upper portion at least one airlock for connection to a submarine and a passageway for a delivery pipe connected to the manifold.

Use of the above method by means of such a structure enables easy solution not only of the problems of connection of the various well heads installed in the compartments of the enclosure structure to the manifold but also that of the connection of the delivery pipe to the manifold which is effected inside the enclosure. In addition the problem of protection of the undersea well heads is solved since each well head lies inside a compartment which forms part of a whole which it is sufficient to arrange below the level of the sea bed in order for it to escape the action of foreign bodies, such for example as icebergs, the bottom of which can hit unprotected installations.

Another object of the invention is to facilitate completion of the wells by providing in each compartment grinding means enabling the connections of the production pipes and various controls to be easily oriented with respect to the enclosure during the installation of the well head.

Another object is to provide the bottom of each compartment with a shape adequate for serving as a receptacle or seat for the first casing of the well, and to give the top portion a shape suitable for supporting a guide-structure and receiving a closure device ensuring watertightness of the compartment.

Thus the present method enables easy completion of the wells, ensures perfect safety of the working parties during connections and sure protection of the well heads in water of relatively little depth.

Other advantages and features of the invention will become apparent from the following description of an embodiment of a structure for use in completion of a group of wells according to the invention given by way of example only, with reference to the attached drawings.

Figure 1:
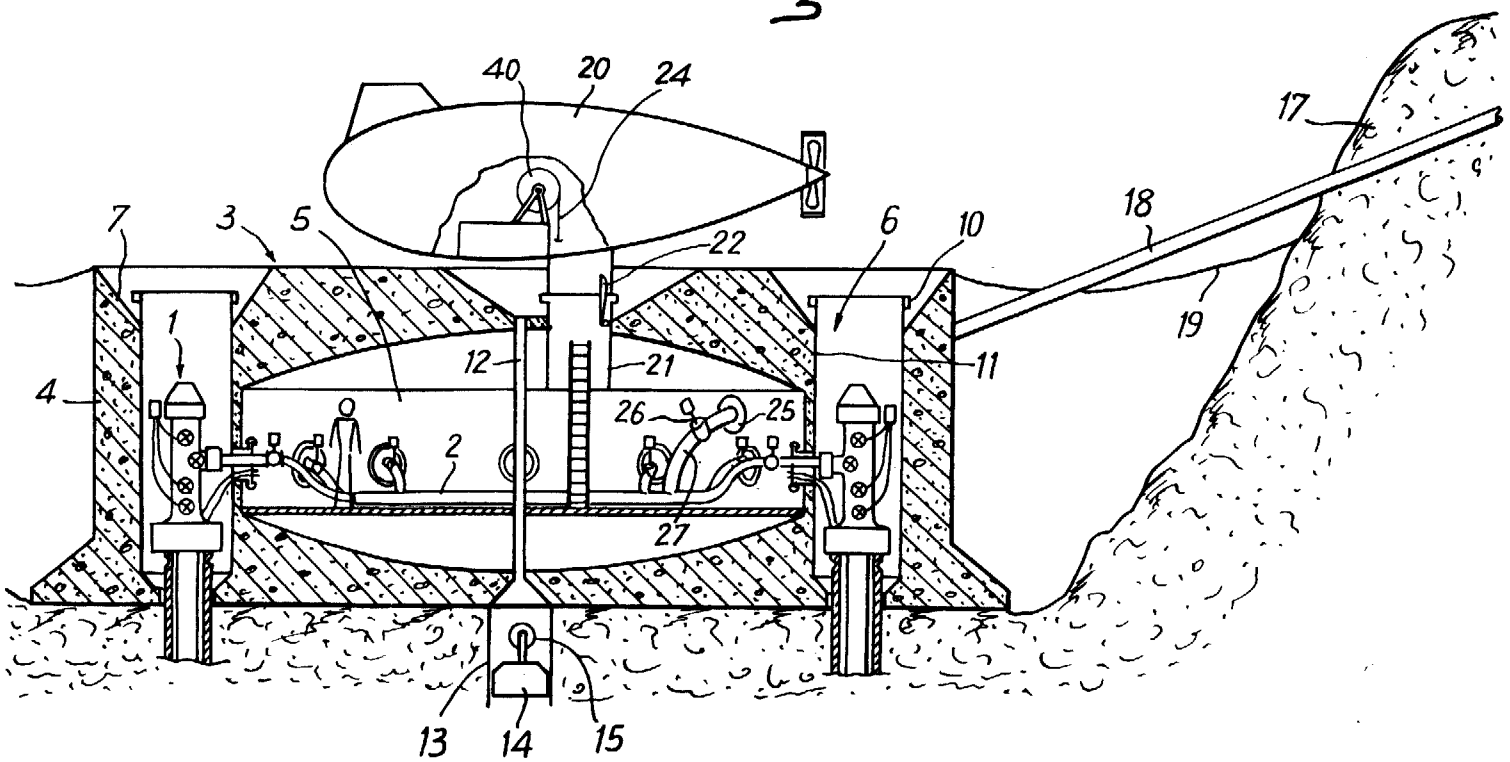
FIG. 1 represents the general diagrammatic view, partially in section, of the structure after completion of the group of wells.
Figure 2:
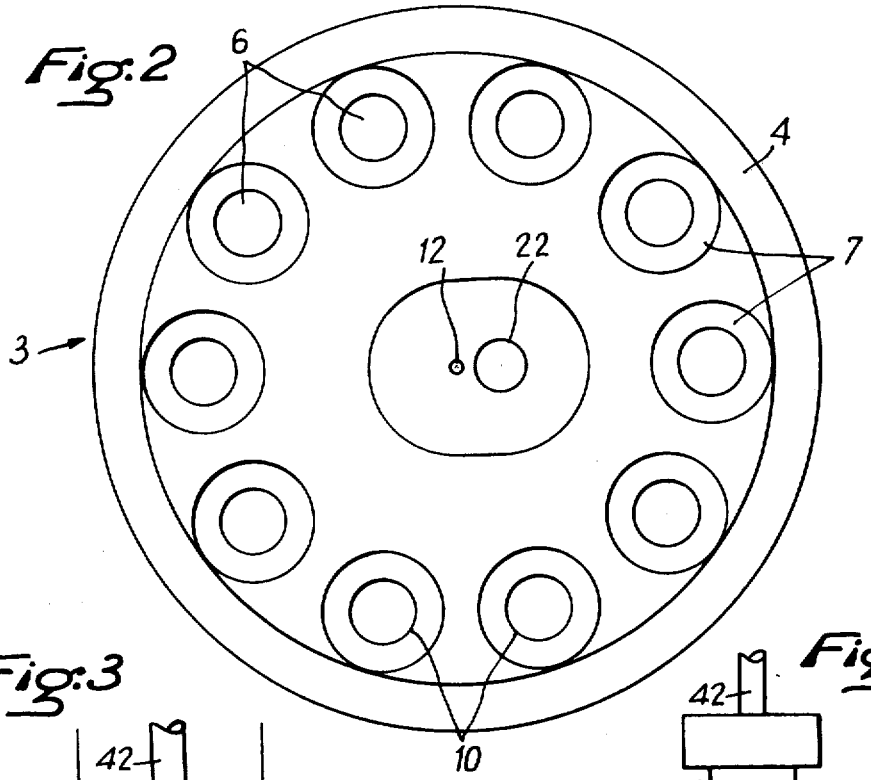
FIG. 2 is a plan of the structure before installation.
Figure 3:
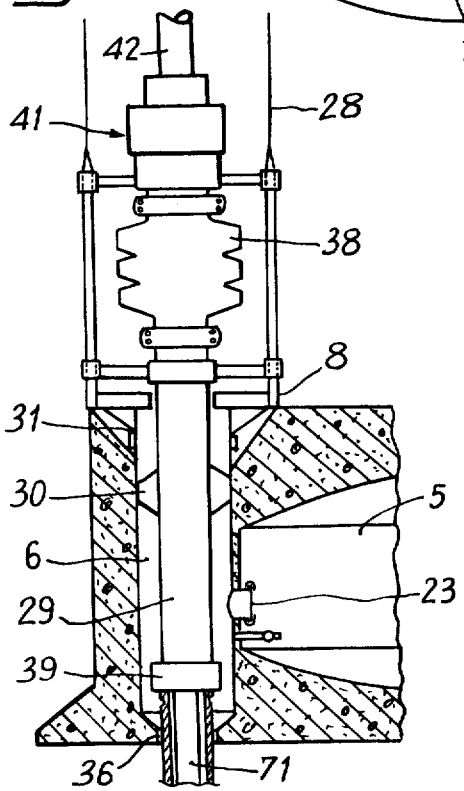
FIG. 3 is a diagrammatic view partially in section of a compartment provided with a guide-structure of vertical columns supporting the preventers.
Figure 4:
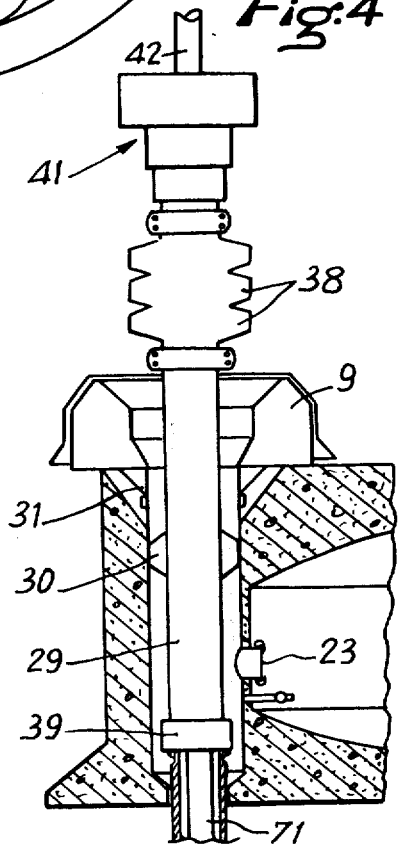
FIG. 4 is a diagrammatic view of a variant of the structure of FIG. 3.
Figure 7:
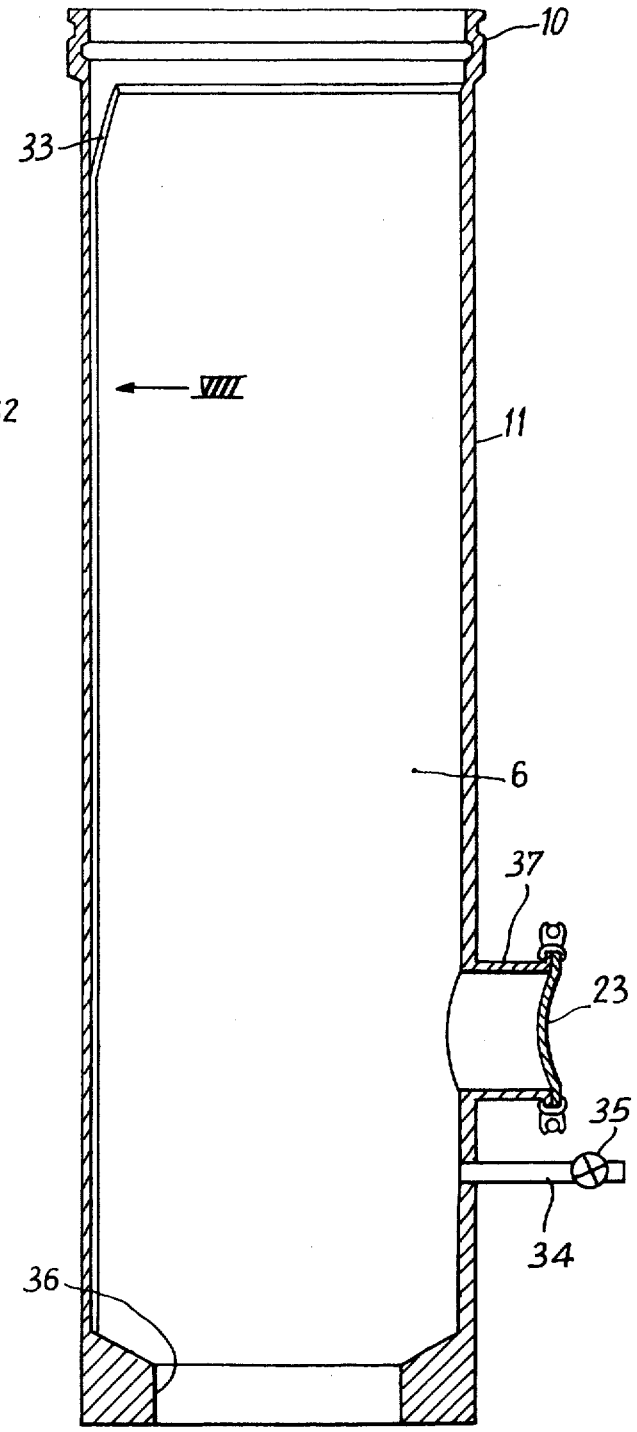
FIG. 7 is a diagrammatic view in section of a compartment before drilling.
Figure 10:
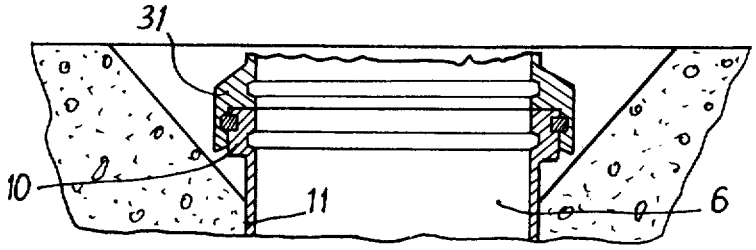
FIG. 10 is a detail of the assembly of the guide structure of the compartment of FIG. 3.

To enable connection of one or, as shown, a plurality of well heads 1, FIG. 1, to a manifold 2 without having to have access directly to the or each well head, a structure 3 is provided. The structure 3 is made of a mass of concrete which defines a central enclosure 5 and peripheral compartments 6, FIG. 2. Recesses 7 surrounding the upper ends of compartments 6 are provided to create clearances for putting in place guide means, such as guide means 8, FIG. 3, or guide means 9, FIG. 4, necessary for the drilling and completion of the wells, and for protecting the top portion of attachment means 10 (FIGS. 1, 7 and 10). The structures 8 and 9 either include guide lines 28 or a simple cone for guidance of the first tools of the first casings and of the preventers. They may also be provided with release means shown diagrammatically at 31, which cooperate with the attachment means 10, FIGS. 7 and 10. In the case where it would be required to put the structure 3 in position using floats, these recesses also enable seating of the bottoms of the floats (not shown), which may be of any type. These floats are preferably attached at their bottoms by means of a remote-controlled connector device to the attachment means 10 at the top portion of a casing 11, FIG. 7, of each compartment 6. Hence the structure 3 may be conveniently lightened during the course of its descent, the floats being recovered after the structure has been placed in position by remote control of the connectors. In the case where more accurate guidance of the structure 3 is required, for example, on to the centre of an excavation, a tube 13 (FIG. 1) is placed at the centre of the excavation. An anchorage 14 surmounted by a pulley 15 around which a guide cable (not shown) has previously been passed is located in the tube 13. The cable passes through a central guide column 12 integral with the structure and passing in a watertight manner through the enclosure 5. Hence it is sufficient to attach one side of the cable to the structure and to wrap the other side round a winch at the surface in order to lower the structure 3 on to the centre of the excavation, the embankment 17 of the excavation may be used to bury a delivery pipe 18 which may be buried in the sea bed.

After lowering the structure and withdrawal of the floats or cable, the pipe 18 may be connected to the manifold 2. This connection is carried out from the inside of the enclosure 5 to which access may be gained by employing a suitable submarine 20 which is connectable to the enclosure through an airlock 21 integral with the structure 3 and a door 22 normally closing the airlock 21. The enclosure 5 is at atmospheric pressure, watertight doors 13, FIG. 3, closing passageways 37 between the enclosure and the compartments, isolating the enclosure from the compartments 6. A cable 24 wrapped round a winch 40 in the submarine 20 enables the pipe 18 to be dragged through a watertight passageway 25 which extends in any known manner through the structure. During the course of this operation the cable 24 passes round a pulley (not shown for greater clarity in the drawing) the plane of which is the vertical plane passing through the delivery pipe 18 and the way 25.

When the pipe has been sufficiently drawn into the enclosure 5, a valve 26 at the end of the pipe 18 is connected to the manifold by means of a connector 27.

The wells are then drilled according to a conventional method except that special guide structures 8 or 9 and an extension pipe 29 are employed. The pipe 29 is provided with centering lugs 30, intended to reduce the bending moment transmitted by the preventers 38 and the riser 42 to the bottom of the extension pipe 29, and is connected to the well head 71 by a connector 39.

In FIG. 7 there is shown one of the compartments 6. Below the watertight door 23 a pipe 34 is provided connecting the compartment 6 to a valve 35 which is connected to a pump (not shown) for subsequent emptying of the compartment 6. At the bottom of the compartment there is a seating 36 of any suitable known type which is used for suspension of the first casing, the assembly of the heads of these casings forming the well head 71. A guide groove 32 is provided opposite the pipe 34 and the passageway 37. The groove serves to orientate a production head 43 accurately. The preventers 38 are attached to the upper portion of the extension pipe 29 with respect to the passageway 37. The bottom connector 39 may be of any type as may units 41 for control and connection of the riser 42.

Figure 5:
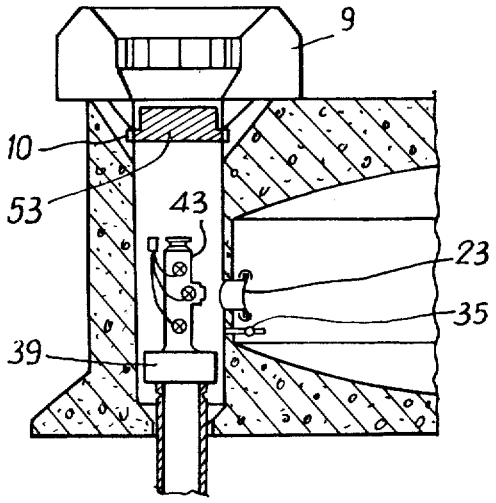
FIG. 5 is a diagrammatic view partially in section of a compartment after lowering of the well head and putting in place of a closure device.
Figure 6:
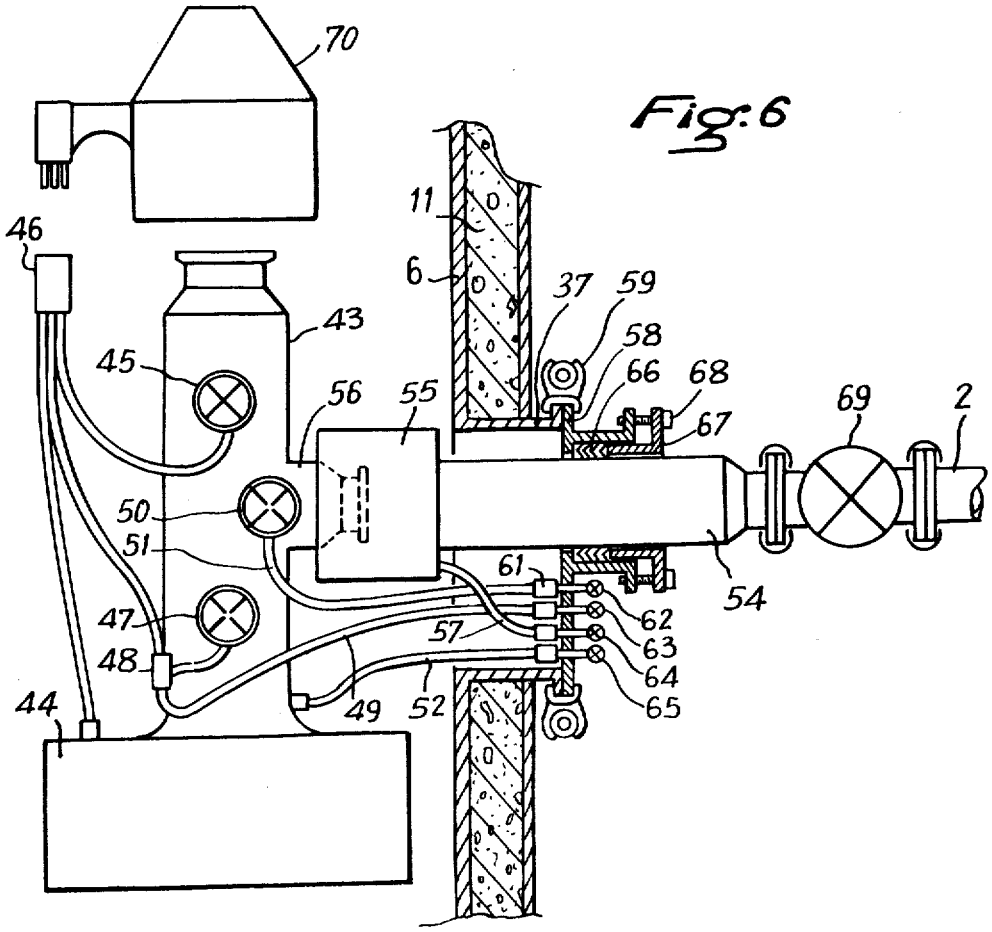
FIG. 6 is a diagrammatic view partially in section of a well head after connection to the manifold in the enclosure.
Figure 8:
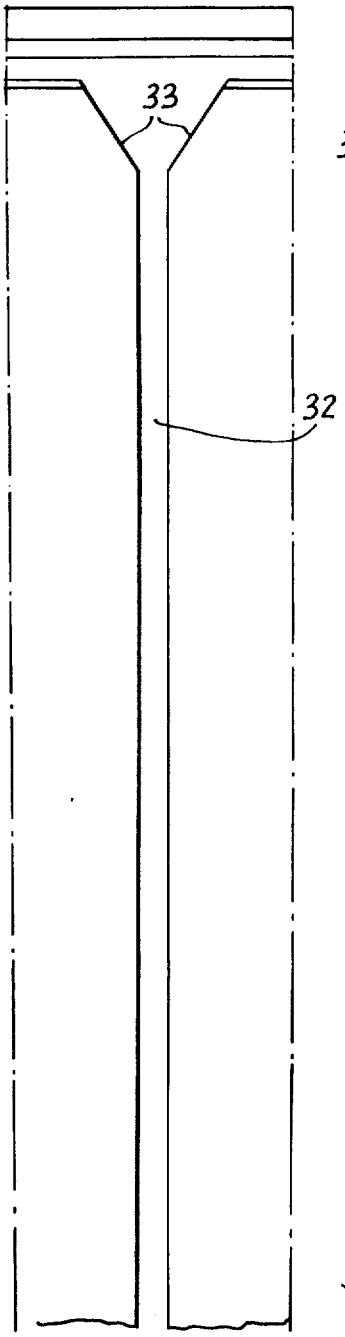
FIG. 8 is a partial view of the inside of a compartment in the direction of the arrow VIII in FIG. 7.

After drilling, putting in place the casings and tubings as well as plugs enabling withdrawal of the preventers 38, the connector 39 is disconnected from the well head 71 and a production head 43, FIGS. 5 and 6, is lowered on to the well head. The head 43 is connected to the well head 71 by a connector 44 already connected to the production head 43. The lines for control of the top valve 45 and the connector 44 are attached to a hydraulic control lines connector 46. The control line for the master valve 47 is connected to a double-acting valve 48 which enables control of the master valve 47 either from the surface by way of the connector 46 or by a direct line 49. A side outlet valve 50 for effluent is controlled by a direct line 51. A control line 52 enables, where necessary, measurement of the pressure in the annulus.

During the course of lowering, the control lines 49, 51 and 52 are attached to the production well head 43 and, as soon as the connector 44 is connected to the well head, the top aperture of the compartment 6 is shut off by a special plug 53 which locks on to the attachment means 10. By connecting the valve 35 to the pump (not shown) in the enclosure 5 the compartment 6 is emptied and the pressures between the enclosure and the compartment are equalized.

The passageway 37 can then be opened by opening or removing the door 23 so that access may be gained to the control lines 49, 51 and 52. It will be observed that it is unnecessary to enter the interior of the compartment 6 in order to carry out the connection of the well to the manifold 2 and that it is sufficient to be able to withdraw the ends of the control lines. By means of any suitable handling device with which the enclosure is equipped, a pipe 54 provided with a connector 55 is connected to the side outlet 56 controlled by the valve 50 on the production head. Connection may be carried out by means of the control line 57. This line may have already been attached to a shut-off connector-plate 58 through which the pipe 54 passes. This plate is attached to a flange on the passageway 37 by means of conventional clamp and sealing means 59. The plate 58 comprises connectors, such as 61, for easy connections of the control lines 49, 51, 52 and 57, connector valves 62 to 65 enabling operation and control of the production head 43 from the inside of the enclosure 5. Watertightness of the pipe 54 with the plate 58 is ensured after connection of the connector 55 by means of watertight sealing means 66 which are clamped against the pipe 54 and between a flanged cylindrical member on the plate 58 and a cylindrical member carrying a flange 67 by means of bolts and nuts 68. At least one valve 69 completes the connection between the pipe 54 and the manifold 2.

Thus contrary to known methods, connection of the well head to the manifold is carried out inside an enclosure without having to enter the space directly surrounding the well head.

When connection has been completed the valve 35 is connected to a water-introduction circuit (not shown) and, after filling the compartment 6 with water, the plug 53 is withdrawn. Tubing (not shown) leading up to the surface may be put into production after fishing up the plugs by the so-called "wire-line" technique of intervention by cables.

The valves 45 and 47 are then closed and the production pipe may be disconnected. A protector cap 70 may be lowered on to the top portion of the head 43 and the connector 46, this lowering being again guided by the groove 32.

Figure 9:
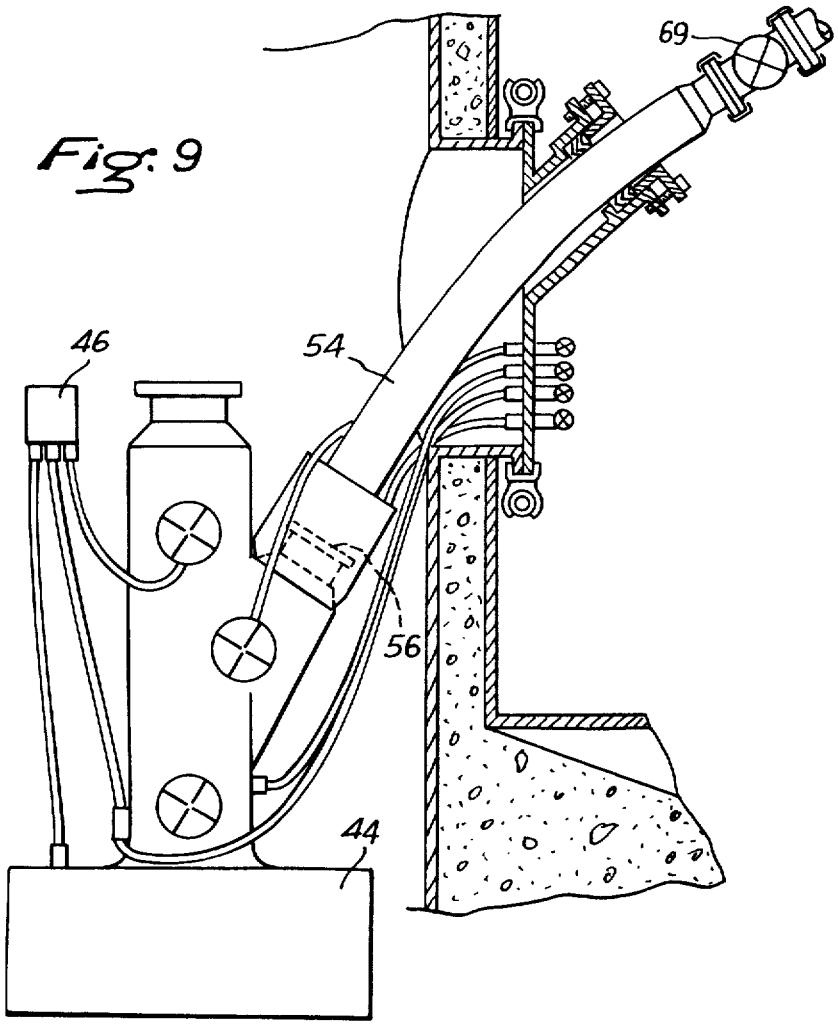
FIG. 9 is a diagrammatic view partially in section of a variant arrangement of the side outlet of the production head.

Although only one embodiment of the structure 3 has been described it will be understood that it may take a number of forms as also may the production heads, the side outlet 56 of which may form an acute angle with the top portion of the head 43. FIG. 9, in order to enable employment of the so-called "through the flow line" technique of intervention via the delivery pipe. In this latter case, the pipe 54 is curved for the passage of pumped tools which are sent into the well from the enclosure 5 and pass through the plate 58 at an angle. Similarly a number of side outlets may be provided on one head, all of these outlets and their controls being connected through a shut-off plate to the enclosure manifold and to control members in the enclosure 5.

What is claimed is:

1. A method of completion of at least one undersea oil well comprising the steps of:

installing a well head in a compartment laterally adjacent to and integral with an enclosure which is in fluid communication with said compartment by way of a separator plate, sealing the enclosure from said compartment by closing said hatch, filling said enclosure with air at atmospheric pressure, lowering said structure vertically within the sea and onto the sea bed where the oil gathering is to be carried out, to allow drilling to occur by access through the open compartment to the well head carried thereby, placing a production head within said compartment, rendering the compartment watertight, removing the water from the compartment from inside the integral enclosure, filling the compartment with a mixture of gases at the pressure of the enclosure, opening said plate between said enclosure and said laterally adjacent compartment, connecting the production head within said compartment to the manifold within said enclosure by a connector plate which seals the compartment from the enclosure in a watertight manner after connection, and opening the compartment to the sea.

2. The method as claimed in claim 1, wherein the production head, as it is lowered onto the well head within the open compartment, is oriented such that a side outlet from the production head for connection to the manifold within the enclosure and the ends of portions of control lines for the valves in the production head are facing said separating plate which separates the enclosure from said compartment.

3. The method as claimed in claim 2, wherein a connection is effected between the well head and the manifold by exchanging said separator plate for said connector plate through which a pipe passes which is connected to the side outlet from the production head within the compartment.

4. The method as claimed in claim 3, further comprising the step of connecting the ends of the control line portions to watertight passageways passing through the connector plate before the connector plate is fixed in place.

5. The method as claimed in claim 1, wherein the step of rendering the compartment watertight comprises the placement of a removable plug within the upper end of said compartment.

6. The method as claimed in claim 1, further comprising the step of connecting an external delivery pipe to the manifold within said enclosure by pulling on a cable from inside the enclosure, which cable passes through a watertight passage extending from the enclosure to its exterior, with the other end of the cable being attached to means closing off the end of the delivery pipe, and connecting the closing means to the manifold when the delivery pipe penetrates the enclosure through said watertight passage.

7. The method as claimed in claim 1, further comprising the step of drilling the well by employing as a suspension of the first casing pipe, a seating provided at the base of said compartment.

8. The method as claimed in claim 1, further comprising the step of locking a removable guide-structure onto attachment means provided on the upper opening of said compartment for mounting of the extension pipe and by employing preventers which are mounted on the extension pipe passing through said compartment for controlling the drilling structure passing through said compartment.

9. The method as claimed in claim 1, further comprising the steps of, prior to lowering the structure onto the sea bed, excavating the sea bed, installing an anchor and guide point, and insuring that the excavation is sufficient such that the top portion of the structure is at least at the level of the sea bed and that the delivery pipe is buried by the embankment resulting from the excavation.

10. A unitary structure for vertical lowering onto a sea bed for undersea drilling of oil wells, said structure comprising:

a central enclosure, means for maintaining said central enclosure at atmospheric pressure, a plurality of compartments mounted to the periphery of said enclosure and integral therewith, means for connecting said enclosure to each compartment by a removable watertight separator plate for access to the compartment interior, each compartment comprising means for receiving a production head and for rendering said compartment watertight, means for removing water from said compartment from inside said enclosure, means for filling each compartment with a mixture of gases at the pressure of said enclosure, a manifold within said enclosure, means for connecting the production head to the manifold through a connector plate which replaces said removable watertight separator plate and which in turn separates said compartment from the enclosure in a watertight manner after said connection, and means for refilling each compartment with water.

11. The structure as claimed in claim 10, further comprising the top and bottom portions of each compartment being open for passage of drilling apparatus.

12. The structure as claimed in claim 11, wherein said compartments are provided with a vertical guide-groove for guiding a production head or a protector cap carried thereby.

13. The structure as claimed in claim 11, wherein the top portion of each compartment is provided with attachment means for attaching a guide-support and a plug.

14. The structure as claimed in claim 10, further comprising a passageway passing through the center of said enclosure in a watertight manner for use as a guide descent of said structure onto said sea bed.

15. The structure as claimed in claim 10, further comprising an airlock within the upper portion of said enclosure and in communication therewith, and recesses in the top openings of said compartments for receiving in succession lightener buoys, guide-supports and plugs.

16. The structure as claimed in claim 10, further including a passageway extending through the wall of said enclosure, watertight seal means for said passageway and a cable extending through said passageway having one end inside the enclosure and the other end external of said enclosure for connection to the end of a delivery pipe.

17. The structure as claimed in claim 10, wherein said means for emptying each compartment comprises a pipe connected to each compartment and to a valve located within said enclosure.

18. The structure as claimed in claim 11, further comprising bottom openings within each of said compartments constituting seats for the first suspension pipes of the well heads.

19. The structure as claimed in claim 10, further comprising a production head within each compartment and means for connecting control lines of valves of said production head to control valves within said enclosure in a watertight manner at atmospheric pressure and for connecting the effluent outlet from each enclosure in a watertight manner to said manifold within said enclosure.

20. The structure as claimed in claim 19, wherein the connection between the production head in each compartment and said manifold includes a pipe passing in a watertight manner through a removable connector plate effecting separation of the enclosure from said compartment, said pipe being provided with a connector connecting the side outlet of the production head to the pipe, and control lines of the connector and control lines of the valves of the production head passing in a watertight manner through said removable connector plate.

21. A structure as claimed in claim 20, wherein the pipe which passes through the removable connector plate is curved and is connected to the side outlet of the production head at an acute angle with the top portion of the head.

* * * * *